US006193554B1

(12) United States Patent
Wu

(10) Patent No.: US 6,193,554 B1
(45) Date of Patent: Feb. 27, 2001

(54) DOUBLE-SHIELDED CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/346,645

(22) Filed: Jul. 1, 1999

(30) Foreign Application Priority Data

Dec. 24, 1998 (TW) ..... 87221560

(51) Int. Cl.[7] ..... H01R 13/648
(52) U.S. Cl. ..... 439/607
(58) Field of Search ..... 439/607, 608, 439/541.5

(56) References Cited

U.S. PATENT DOCUMENTS 4,689,723 * 8/1987 Myers et al. ..... 439/607
4,913,664 * 4/1990 Dixon et al. ..... 439/607
5,007,862 * 4/1991 Defibaugh et al. ..... 439/607

* cited by examiner

*Primary Examiner*—Neil Abrams
*Assistant Examiner*—Javaid Nasri
(74) *Attorney, Agent, or Firm*—Wei Te Chung

(57) ABSTRACT

An electrical connector includes a casing defining at least one front receiving slot with a number of contact elements retained therein. The casing has two opposite side walls. Each side wall includes two wall segments spaced from and parallel to each other thereby defining a channel between the front receiving slot and a rear face of the casing. An inner shielding member is fit into and retained in each receiving slot. The inner shielding member has two rear extensions inserted into the channels. An outer shielding member encloses the casing and has two inward flanges extending into the channels for electrically and mechanically engaging with the corresponding rear extensions of the inner shielding member to retain the inner and outer shielding members on the casing and to form electrical connection therebetween. The outer shielding member has grounding tabs connected to a circuit board for grounding purposes thereby also grounding the inner shielding member.

12 Claims, 9 Drawing Sheets

DOUBLE-SHIELDED CONNECTOR

BACKGROUND OF THE INVENTION

1. Field of the Invention

The present invention generally relates to an electrical connector, and in particular to a double-shielded connector having excellent properties for shielding against electromagnetic interference (EMI).

2. The Prior Art

An electrical connector connects two devices together and transmits signals therebetween. To ensure proper signal transmission, a connector is provided with a shielding means for preventing the connector from being adversely affected by external electromagnetic interference (EMI). Related examples are disclosed in Taiwan Patent Application Nos. 85204902, 85208558, 85212192, 85215759 and 86214118. However, the conventional shielding means cannot completely shield the connector thereby resulting in poor EMI protection.

FIGS. 1 and 2 of the attached drawings show a conventional connector having a shielding means. The connector includes an insulative casing 1 comprising two tongue plates 11 and a partition plate 12 separating the two tongue plates 11 which support contact elements (not labeled) thereon. The shielding means comprises a rear shielding plate 2 and a front shielding member The rear shielding plate 2 defines a plurality of frames 21 for engaging with barbs 13 formed on the casing 1 thereby retaining the rear shielding plate 2 on the casing 1.

The front shielding member 3 comprises a housing 31 enclosing the casing 1 and having a plurality of resilient arms 312 stamped thereon thereby forming openings 311 associated with the arms 312. The resilient arms 312 serve to electrically and mechanically engage mating connectors coupled to the connector. The front shielding member 3 further comprises a U-shaped inner housing 32 which is fit over the partition plate 12 and retained thereon for electrically isolating the contact elements of the tongue plates 11. A number of resilient arms 322 are stamped on the inner housing 32 thereby forming openings 321 associated therewith.

However, the casing 1 is not completely shielded by the shielding means due to the openings 312, 321. Thus, proper signal transmission through the connector is not ensured.

Hence, it is desired to have an electrical connector providing excellent EMI protection.

SUMMARY OF THE INVENTION

Accordingly, an object of the present invention is to provide an electrical connector having excellent EMI properties.

Another object of the present invention is to provide an electrical connector having a double-shielded structure for providing EMI protection.

To achieve the above objects, an electrical connector in accordance with the present invention comprises a casing defining at least one front receiving slot with a number of contact elements retained therein. The casing has two opposite side walls. Each side wall includes two wall segments spaced from and parallel to each other and defining a channel between the front receiving slot and a rear face of the casing. An inner shielding member is fit into and retained in each receiving slot. The inner shielding member has two rear extensions inserted into the channels. An outer shielding member encloses the casing and has two inward flanges extending into the channels for electrically and mechanically engaging with the corresponding rear extensions of the inner shielding member to retain the inner and outer shielding members on the casing and to form electrical connection therebetween. The outer shielding member has grounding tabs connected to a circuit board for grounding purposes thereby also grounding the inner shielding member.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
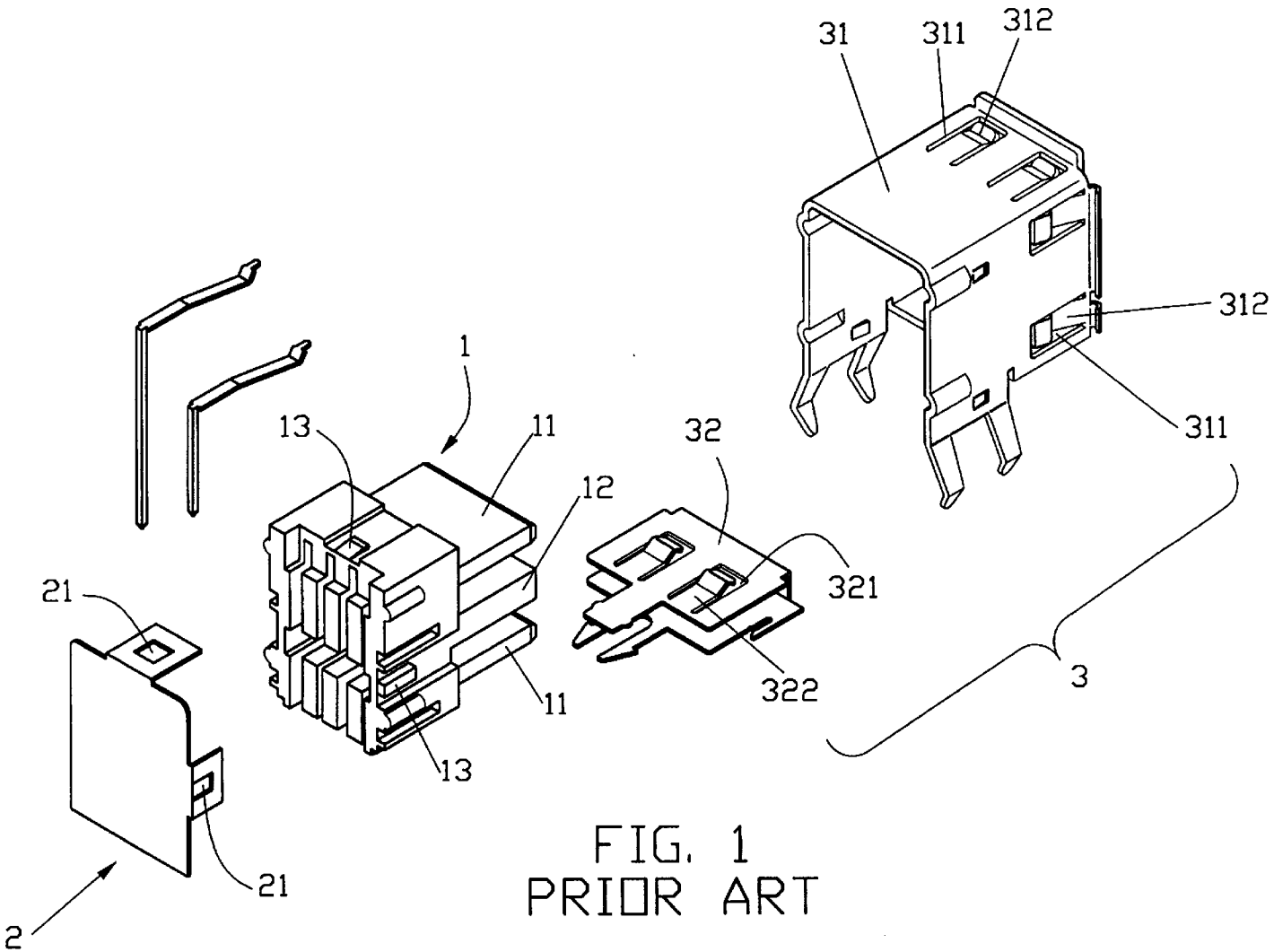
FIG. 1 PRIOR ART
FIG. 1 is an exploded view of a conventional electrical connector.
Figure 2:
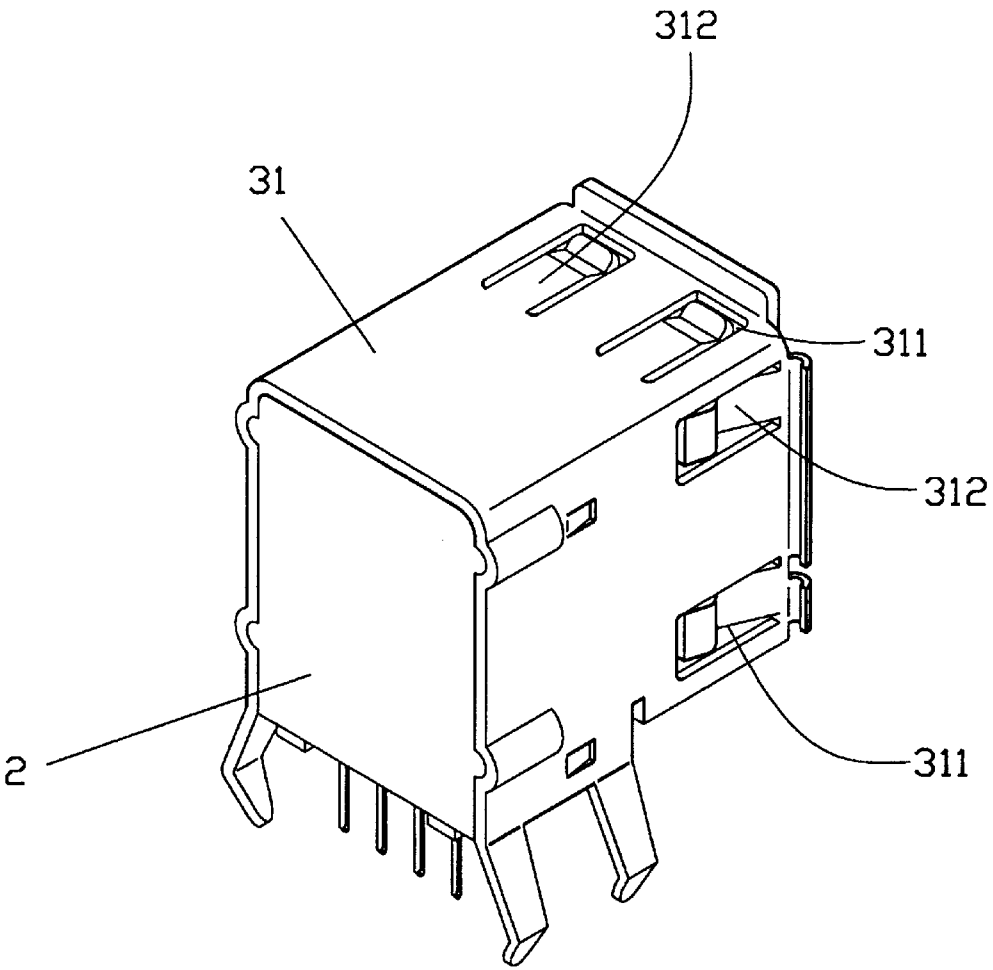
FIG. 2 PRIOR ART
FIG. 2 is an assembled view of FIG. 1.
Figure 3:
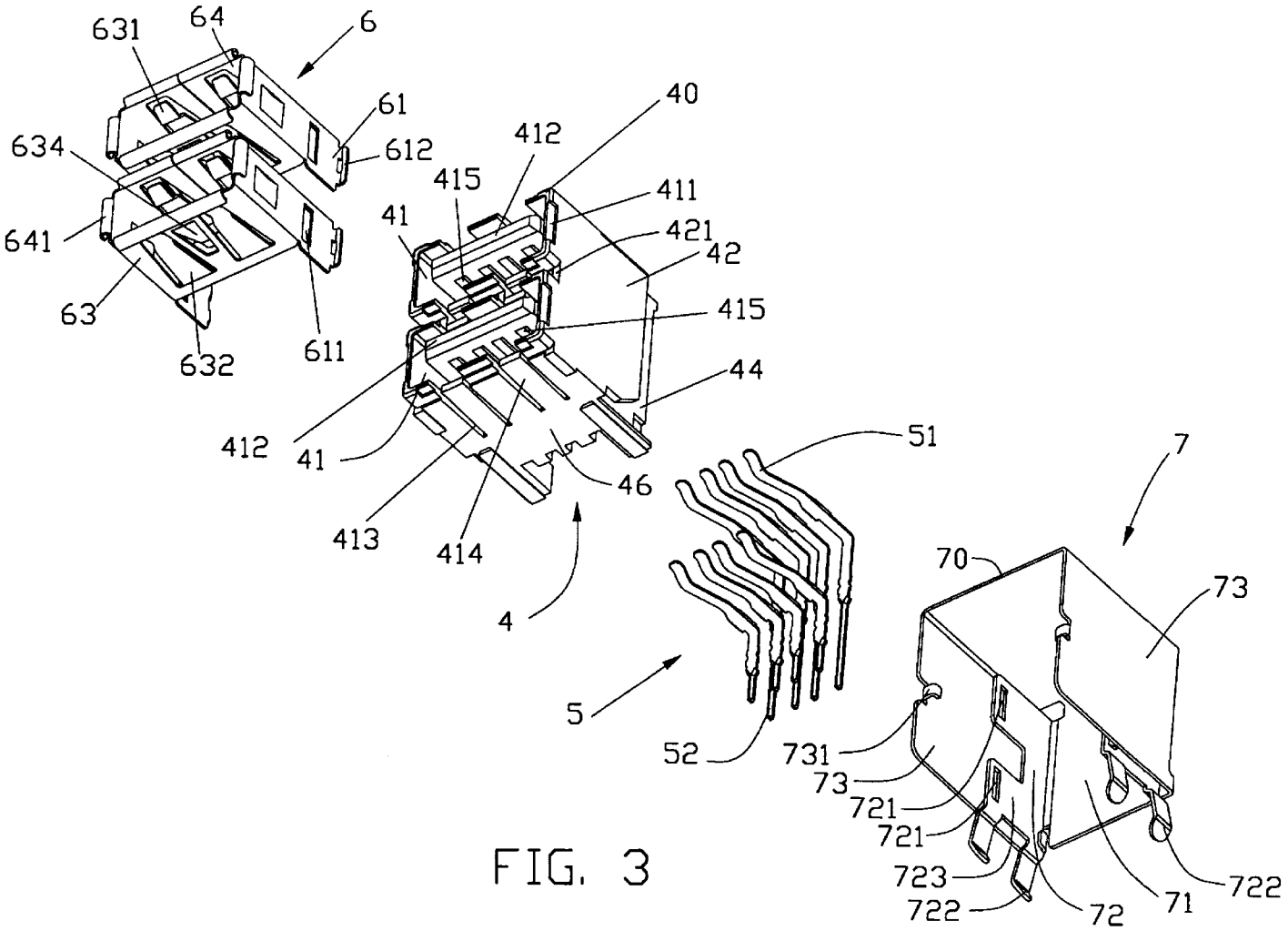
FIG. 3 is an exploded view of an electrical connector constructed in accordance with the present invention.
Figure 5:
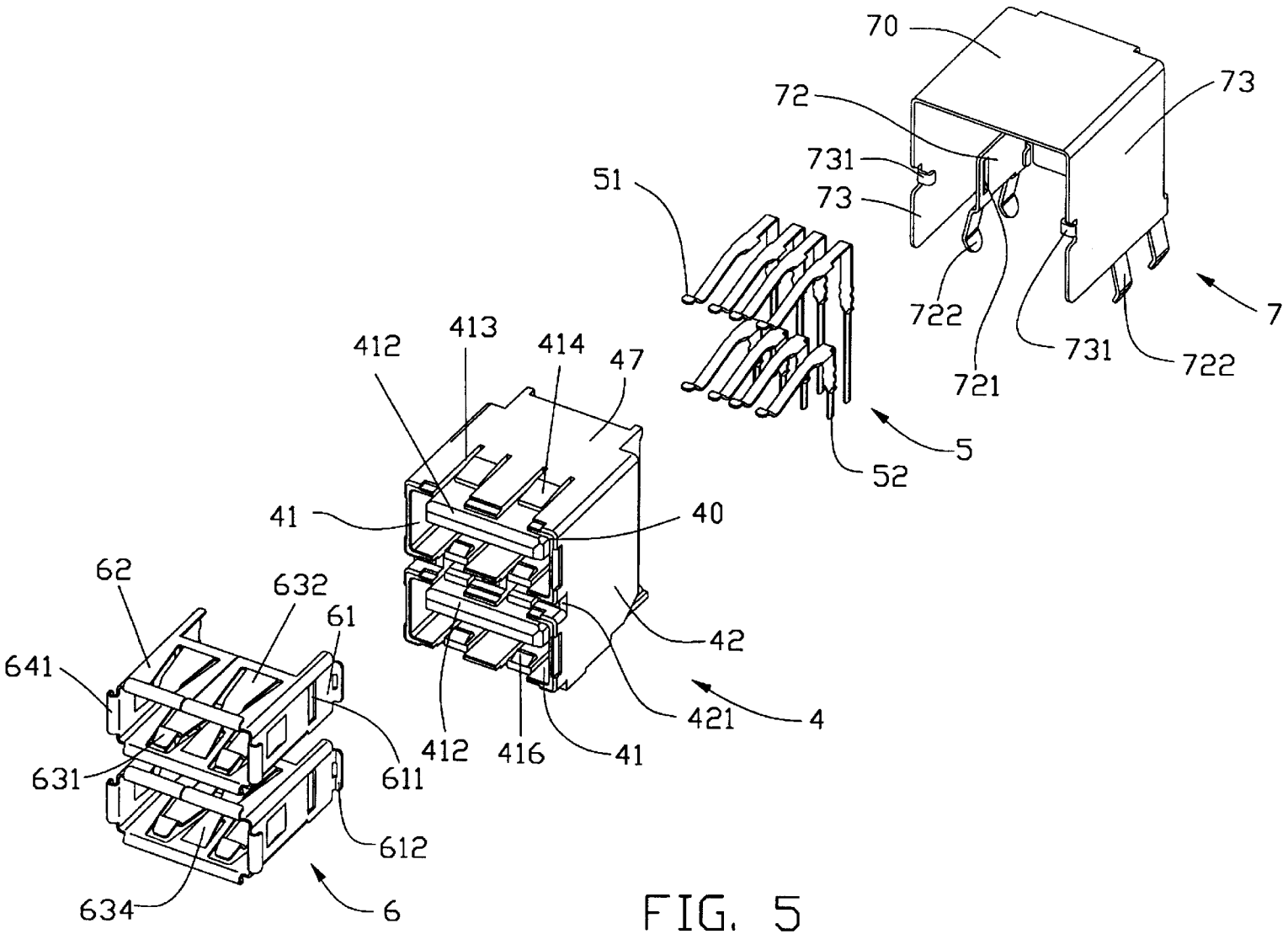
FIG. 5 is similar to FIG. 3 but taken from a different perspective.
Figure 7:
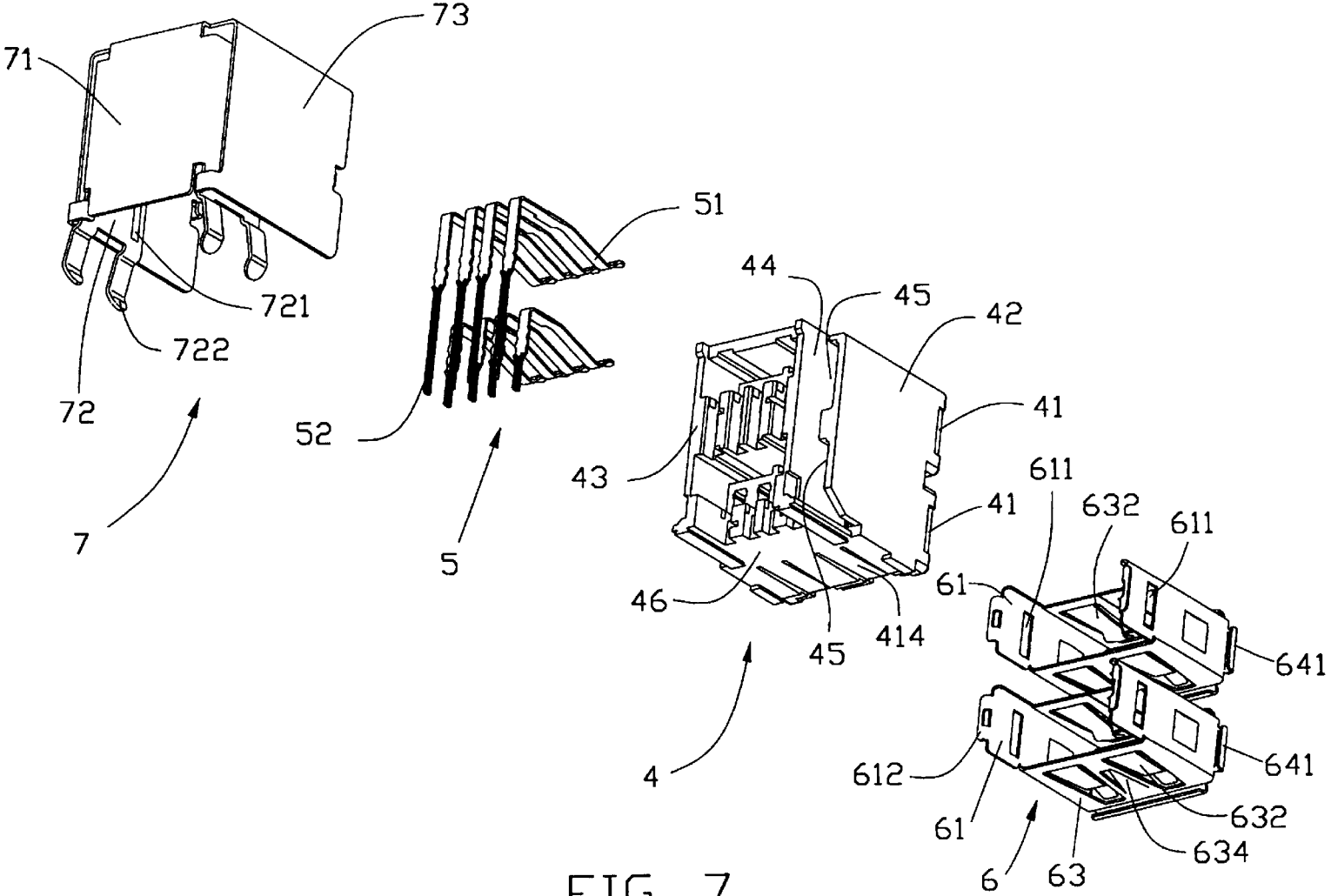
FIG. 7 is similar to FIGS. 3 and 5 but taken from a different perspective.

Referring to the drawings and in particular to FIGS. 3, 5 and 7, an electrical connector in accordance with the present invention comprises an insulative casing 4 defining a pair of receiving slots 41 for retaining contact elements 5 therein. An inner shielding member 6 is received in each receiving slot 41 for surrounding the contact elements 5. Each inner shielding member 6 defines a front opening 64 for receiving a mating connector (not shown). An outer shielding member 7 encloses the insulative casing 4 and is in electrical connection with the inner shielding members 6 for providing excellent EMI protection.

Figure 6:
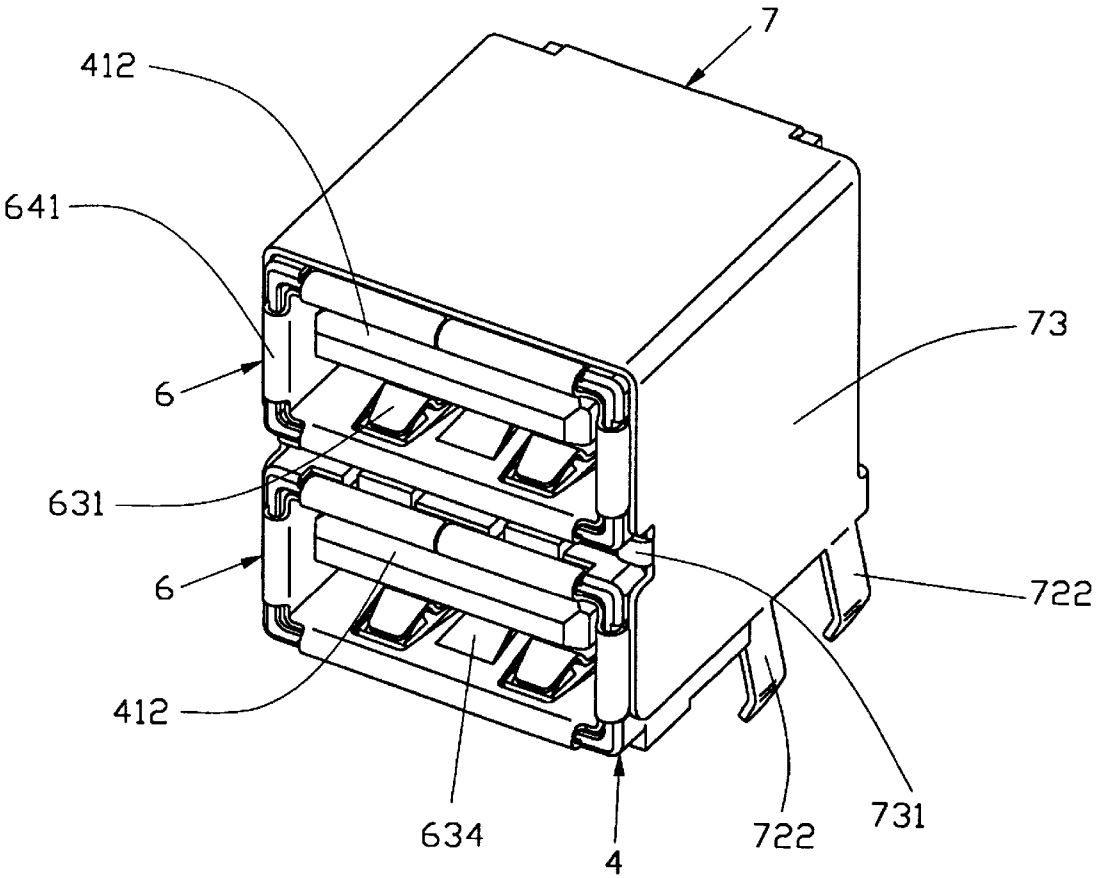
FIG. 6 is an assembled view of FIG. 5.
Figure 8:
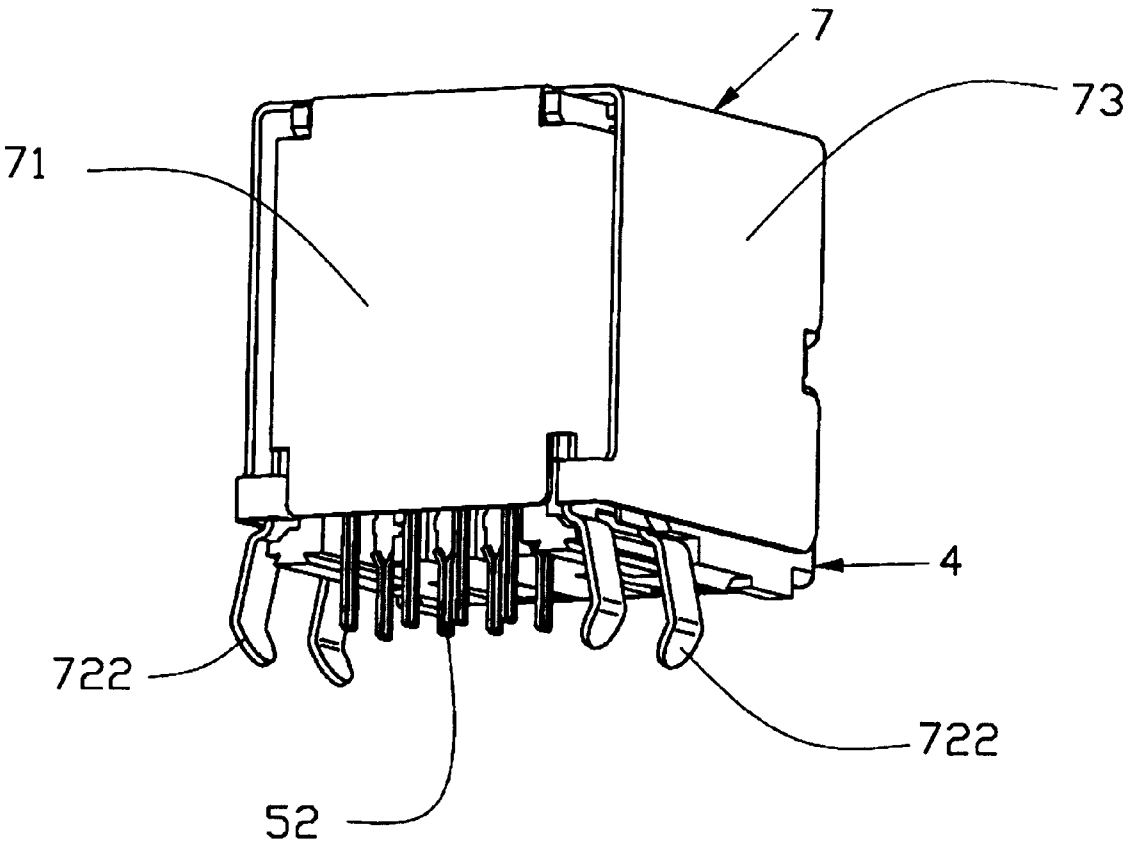
FIG. 8 is an assembled view of FIG. 7.

The casing 4 has a front mating face 40 in which the receiving slots 41 are formed and an opposite rear face 43. A tongue plate 412 is arranged in each receiving slot 41 and defines a plurality of grooves 415 in a face (not labeled) thereof. The contact elements 5 have mating sections 51 received in the grooves 415 of the tongue plate 412 for electrically engaging with the mating connector received in the corresponding receiving slot 41. The contact elements 5 further comprise mounting sections 52 perpendicularly extending from the mating sections 51 and beyond the casing 4, as shown in FIGS. 6 and 8, for being electrically connected to a circuit board (not shown).

The receiving slots 41 of the casing 4 are defined between a top wall 47, a bottom wall 46 and two common side walls 42 formed between the top and bottom walls 47, 46. The top and bottom walls 47, 46 each define two slits 413 therein for forming two resilient arms 414 each having a raised portion 416 projecting into the corresponding receiving slot 41. Each side wall 42 has an inner wall segment 44 inwardly spaced from the side wall 42 thereby defining a channel 45 therebetween. The channel 45 extends from the corresponding receiving slot 41 to a rear opening (not labeled) of the casing 4.

Each inner shielding member 6 is fit in the corresponding receiving slot 41. Each inner shielding member 6 has top and bottom panels 62, 63 each forming resilient tabs 632 having convex free ends 631. The resilient tabs 632 are supported on the corresponding resilient arms 414 of the casing 4 with the convex free ends 631 supported by the raised portions 416 of the resilient arms 414. The resilient arms 414 and the tabs 632 resiliently engage with and retain the mating connectors received in the receiving slots 41. The inner shielding member 6 forms a latch 634 projecting into the corresponding receiving slot 41 for electrically engaging with the mating connector for grounding purposes.

Each inner shielding member 6 has two outward flanges 641 formed on opposite sides thereof for engaging with notches 411 defined in the side walls 42 thereby securing the inner shielding member 6 to the casing 4. The inner shielding member 6 also has two rear extensions 61 received in the corresponding channels 45 of the side walls 42. Each rear extension 61 has an outward flange 612 engaging with a rear edge of the corresponding side wall 42 for securely retaining the inner shielding member 6 in the receiving slot 41.

Figure 9:
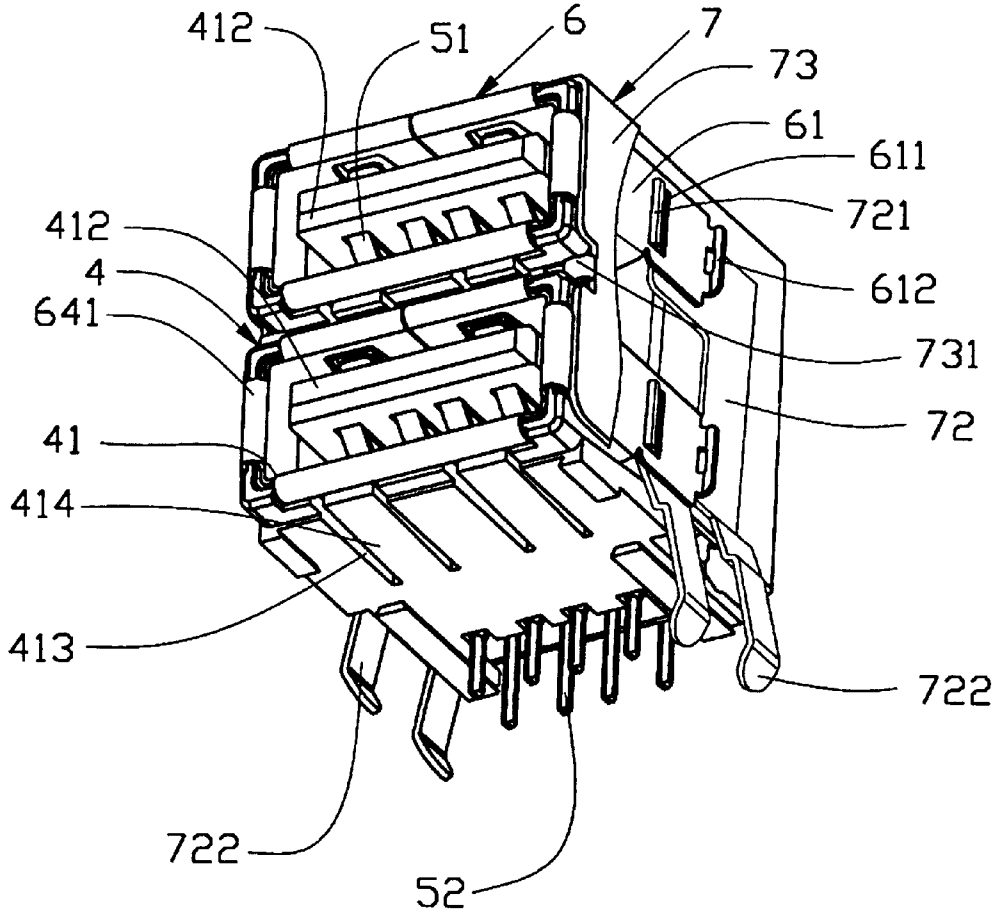
FIG. 9 is a perspective view of the electrical connector of the present invention with a portion thereof cut away to show an inner structure thereof.

The outer shielding member 7 comprises a top panel 70, and two side panels 73 and a rear panel 71 extending from the top panel 70 for receiving the casing 4 therebetween with the rear panel 71 abutting against the rear face 43 and the side panels 73 abutting against the side walls 42 thereof. Each side panel 73 comprises an inwardly extending resilient flange 72 having extensions 723 inserted into the channels 45 of the corresponding side wall 42. Each extension 723 of the side panel 73 forms a barb 721 for engaging with a corresponding opening 611 defined in each rear extension 61 of the inner shielding members 6 (FIG. 9) thereby securely retaining the outer and inner shielding members 7, 6 together and forming an electrical connection therebetween.

Grounding tabs 722 extend from the flanges 72 of the outer shielding member 7 for being connected to a circuit board for grounding purposes. Due to electrical connection between the inner shielding members 6 and the outer shielding member 7, the inner shielding members 6 are also electrically grounded.

Figure 4:
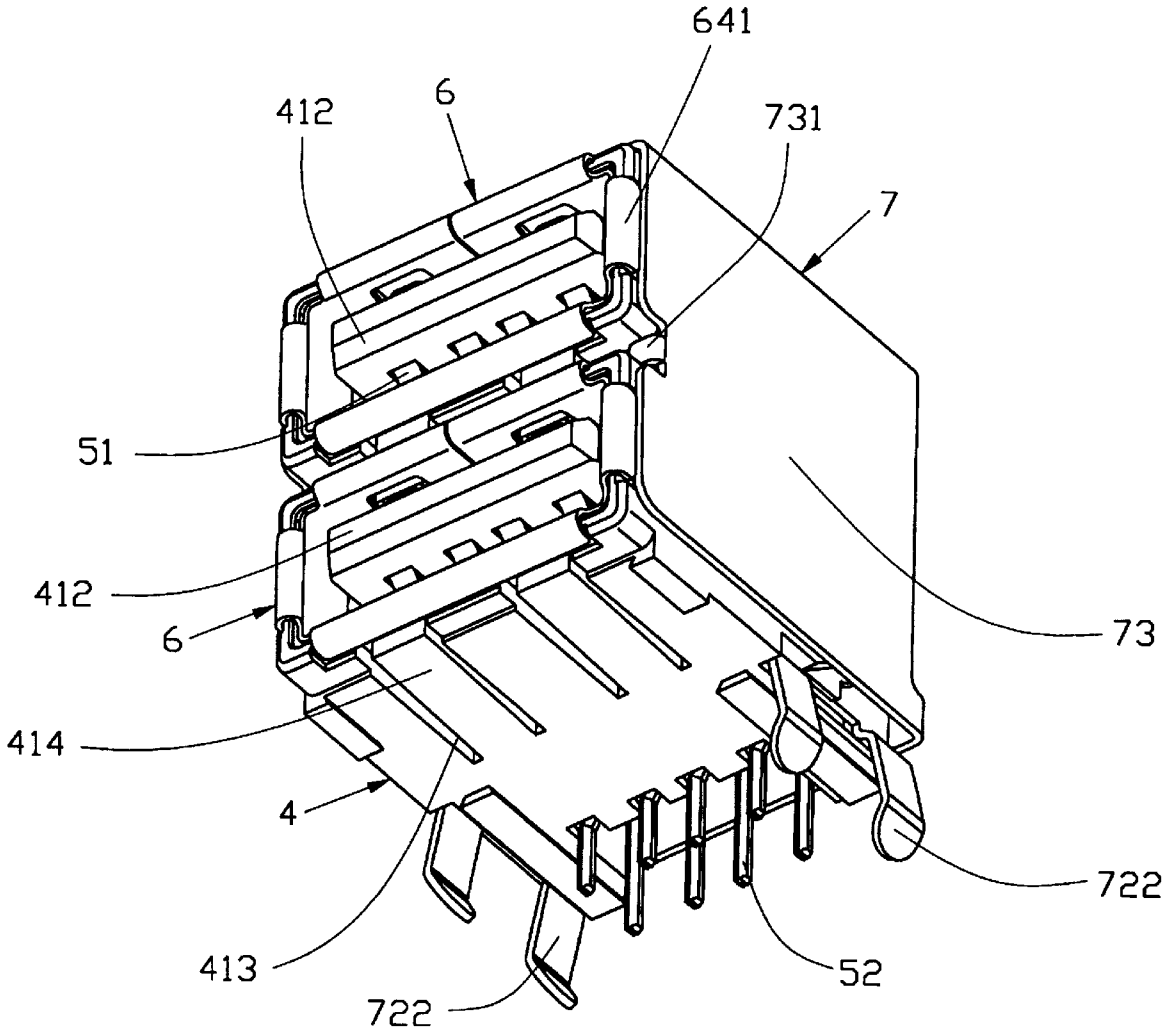
FIG. 4 is an assembled view of FIG. 3.

Also referring to FIGS. 4 and 6, the outer shielding casing 7 further forms inwardly extending clasps 731 which engage corresponding recesses 421 defined in the front face 40 of the casing 4, preferably between the receiving slots 41, thereby securing the casing 4 in the outer shielding casing 7 between the clasps 731 and the rear panel 71.

Although the connector of the present invention comprises side walls 42 and top and bottom walls 47, 46, it is apparent that, if desired, the walls 42, 46, 47 thereof may be partially or entirely eliminated provided the tongue plates 412 may be securely retained and supported by the inner and outer shielding members 6, 7. The inner and outer shielding members 6, 7 may thus be integrally formed as a single piece for surrounding the tongue plates 412 with the contact elements 5 mounted thereon. The essence of the present invention is that an additional outer shielding member 7 is provided to enclose the inner shielding members 6 with the contact elements 5 arranged therein. Furthermore, the outer shielding member 7 is substantially continuous with no openings formed therein thereby completely shielding the contact elements 5.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

an insulative casing defining at least one receiving slot in a front face thereof adapted to receive a mating connector, contact elements being retained in the receiving slot for electrically engaging with the mating connector;

at least one inner shielding member received in the receiving slot for surrounding the contact elements, the inner shielding member having at least one extension; and an outer shielding member substantially enclosing the casing and forming grounding tabs for being electrically grounded, the outer shielding member having a portion corresponding to and engaging with the extension of the inner shielding member for grounding the inner shielding member;

wherein the casing has at least one side wall comprising outer and inner wall segments spaced from and parallel to each other for defining a channel therebetween through which the extension of the inner shielding member extends for engaging with the portion of the outer shielding member, the channel being defined between the receiving slot and a rear opening of the casing the portion of the outer shielding member that engages with the extension of the inner shielding member comprising an inward flange extending from the outer shielding member and received in the channel for engaging with the extension of the inner shielding member, the inward flange of the outer shielding member forming a barb for engaging with an opening defined in the extension of the inner shielding member.

2. The electrical connector as claimed in claim 1, wherein the casing has two opposite side walls, each defining a channel, and wherein the inner shielding member has two extensions for being inserted into the channels, the outer shielding member having two inwardly extending flanges respectively received in the channels for electrically engaging with the extensions of the inner shielding member.

3. The electrical connector as claimed in claim 2, wherein each inwardly extending flange of the outer shielding member forms a barb for engaging with an opening defined in the corresponding extension of the inner shielding member.

4. The electrical connector as claimed in claim 1, wherein the casing defines two spaced receiving slots adapted to receive two mating connectors, each receiving slot retaining contact elements therein for electrically engaging with the corresponding mating connector, the casing having two side walls each comprising two spaced wall segments defining a channel therebetween from each receiving slot to a rear opening of the casing, each receiving slot receiving an inner shielding member therein, the inner shielding member having two extensions inserted into the corresponding channels, the outer shielding member having two inwardly extending flanges each forming two extensions received in the corresponding channels for engaging with the extensions of the inner shielding members.

5. The electrical connector as claimed in claim 1, wherein the extension of the inner shielding member extends beyond and engages with a rear face of the casing, the inner shielding member further comprising an outwardly extending front flange for engaging with a notch defined in the front face thereby retaining the inner shielding member in the receiving slot.

6. The electrical connector as claimed in claim 1, wherein the casing comprises a tongue plate fixed in the receiving slot and surrounded by the inner shielding member, a plurality of grooves being defined in a surface of the tongue plate for receiving and retaining the contact elements.

7. The electrical connector as claimed in claim 1, wherein the contact elements have mounting sections extending beyond the casing adapted to be electrically connected to a circuit board, the grounding tabs of the outer shielding member being mounted to the circuit board and grounded thereto.

8. The electrical connector as claimed in claim 1, wherein the outer shielding member comprises a top panel from which two side panels and a rear panel extend for receiving the casing therebetween.

9. The electrical connector as claimed in claim 8, wherein each side panel of the outer shielding member forms the inward flange, and wherein the casing has two side walls each defining the channel therethrough between the receiving slot and the rear opening of the casing for receiving the inward flange of the outer shielding member therein, the extension of the inner shielding member being inserted into the channel for electrically engaging with the corresponding inward flange of the outer shielding member.

10. The electrical connector as claimed in claim 8, wherein the rear panel of the outer shielding member engages with a rear face of the casing, each side panel of the outer shielding member forming an inwardly extending clasp for engaging with a recess defined in a front face of the casing for retaining the outer shielding member on the casing.

11. The electrical connector as claimed in claim 1, wherein the inner shielding member has a top and a bottom panels forming resilient latches each having a convex portion projecting into the receiving slot for electrically and mechanically engaging the mating connector.

12. The electrical connector as claimed in claim 11, wherein the casing has top and bottom walls corresponding to the top and bottom panels of each inner shielding member, the top and bottom walls forming resilient arms corresponding to and supporting the resilient latches of the inner shielding member, the resilient arms having raised portions for supporting the convex portions of the latches.

* * * * *